US007436377B2

(12) United States Patent
Amano et al.

(10) Patent No.: US 7,436,377 B2
(45) Date of Patent: Oct. 14, 2008

(54) DISPLAY

(75) Inventors: Ryuhei Amano, Hirakata (JP); Haruhiko Murata, Ibaraki (JP)

(73) Assignee: Sanyo Electric Co., Ltd., Osaka (JP)

( * ) Notice: Subject to any disclaimer, the term of this patent is extended or adjusted under 35 U.S.C. 154(b) by 631 days.

(21) Appl. No.: 10/947,666

(22) Filed: Sep. 23, 2004

(65) Prior Publication Data

US 2005/0093785 A1 May 5, 2005

(30) Foreign Application Priority Data

Sep. 26, 2003 (JP) ..... 2003-335364

(51) Int. Cl.
*G09G 3/30* (2006.01)

(52) U.S. Cl. ..... 345/77; 345/76; 348/800

(58) Field of Classification Search ..... 345/63, 345/77, 82–83, 87, 100, 76; 315/169.3; 348/800, 348/801

See application file for complete search history.

(56) References Cited

U.S. PATENT DOCUMENTS

| | | | | |
|---|---|---|---|---|
| 5,724,456 | A * | 3/1998 | Boyack et al. | 382/274 |
| 2001/0035850 | A1* | 11/2001 | Okamoto et al. | 345/77 |
| 2002/0101396 | A1* | 8/2002 | Huston et al. | 345/87 |
| 2003/0016189 | A1 | 1/2003 | Abe et al. | |
| 2003/0122759 | A1* | 7/2003 | Abe et al. | 345/89 |
| 2003/0169247 | A1* | 9/2003 | Kawabe et al. | 345/204 |
| 2003/0227442 | A1* | 12/2003 | Nishi et al. | 345/156 |
| 2005/0231498 | A1 | 10/2005 | Abe et al. | |

FOREIGN PATENT DOCUMENTS

| | | |
|---|---|---|
| CN | 1424707 A | 6/2003 |
| JP | 2003-122308 | 4/2003 |
| JP | 2003-228317 | 8/2003 |

OTHER PUBLICATIONS

Chinese Office Action issued in Chinese Patent Application No. CN 200410079854X, mailed Nov. 23, 2007.

Japanese Office Action, Issued in Japanese Patent Application No. 2003-335364, dated on Apr. 22, 2008.

* cited by examiner

*Primary Examiner*—Richard Hjerpe
*Assistant Examiner*—Shaheda A Abdin
(74) *Attorney, Agent, or Firm*—McDermott Will & Emery LLP

(57) ABSTRACT

A display is provided with a self-light emitting display unit and includes: first means detecting the maximum value of input signals on each line; second means not only determining which of predetermined plural classes each line belongs to using the maximum value of the line and predetermined threshold values, but also calculating a total number of lines belonging to each class; and third means determining the number of lighting-up times in each class in one field period based on the total number of lines belonging to the class obtained by the second means and a predetermined reference total number of lighting-up times and furthermore, determining the number of lighting-up times on each line in one field period based on a result of classification on the line obtained by the second means and the number-of lighting-up times on each class in one field period.

4 Claims, 6 Drawing Sheets

FIG. 4

| CONDITIONS | TOTAL NUMBERS OF LIGHTING-UP TIMES Z | C0 | C1 | C2 | C3 |
|---|---|---|---|---|---|
| $Z[2] \leqq N$ | Z[2] | 1 | 2 | 3 | 4 |
| $Z[1] \leqq N < Z[2]$ | Z[1] | 1 | 1 | 2 | 2 |
| $N < Z[1]$ | Z[0] | 1 | 1 | 1 | 1 |

FIG. 5

| LINE NUMBERS (v) | CLASSIFICATION (C) | LIGHTING-UP TIMES (T) | | | |
|---|---|---|---|---|---|
| | | FIRST TIME | SECOND TIME | THIRD TIME | FOURTH TIME |
| [0] | C[0] | H | L | L | L |
| [1] | C[3] | H | H | H | H |
| [2] | C[2] | H | H | H | L |
| : | : | : | : | : | : |
| [L-1] | C[1] | H | H | L | L |

FIG. 6

| LINE NUMBERS (v) | LIGHTING-UP TIMES (T) | | | |
|---|---|---|---|---|
| | FIRST TIME | SECOND TIME | THIRD TIME | FOURTH TIME |
| [0] | H | L | L | L |
| [1] | H | H | H | H |
| [2] | H | H | H | L |
| : | : | : | : | : |
| [L-1] | H | H | L | H |

DISPLAY

BACKGROUND OF THE INVENTION

1. Field of the Invention

The present invention relates to a display having data electrodes and scanning electrodes arranged in a matrix and provided with a self-light emitting display unit performing lighting-up and displaying on each scanning line as a unit.

2. Prior Art

In a self-light emitting display unit having data electrodes and scanning electrodes arranged in a matrix and performing lighting-up and displaying on each scanning line as a unit, the scanning electrodes on one line in which lighting-up is performed are applied with a voltage at the same time that a signal on the one line is supplied to the data electrodes thereof. Such a display unit generally lights up all the lines the same number of lighting-up times as one another and while with a more number of lighting-up times in one field period, a display luminance are enhanced, there has been difficulty in sufficiently increasing a peak luminance because the number of line lighting-up times is restricted by performances such as that of a scanning driver.

SUMMARY OF THE INVENTION

It is an object of the present invention to provide a display capable of enhancing a peak luminance value.

A first display according to the present invention is provided with a self-light emitting display unit and includes means for controlling a lighting-up scheme and an input signal on each line depending on a level distribution of the maximum values of input signals on respective lines.

A second display according to the present invention is provided with a self-light emitting display unit and includes: first means detecting the maximum value of input signals on each line; second means not only determining which of predetermined plural classes each line belongs to using the maximum value of the line and predetermined threshold values, but also calculating a total number of lines belonging to each class; third means determining the number of lighting-up times in each class in one field period based on the total number of lines belonging to the class obtained by the second means and a predetermined reference total number of lighting-up times and furthermore, determining the number of lighting-up times on each line in one field period based on a result of classification on the line obtained by the second means and the number of lighting-up times on each class in one field period; and fourth means not only performing correction processing for input signals on each line in one field based on the number of lighting-up times on each line in the one field period determined by the third means, but also controlling a self-light emitting display unit using the numbers of lighting-up times on each line in one field determined by the third means and an input signal after the correction processing.

The third means is, for example, means calculating a total number of lighting-up times based on a total number of lines belonging to each class obtained by the second means for each of plural lighting-up patterns wherein a pattern of the number of lighting-up times for each class is different from the other and comparing the calculated total number of lighting-up times with the predetermined reference total number of lighting-up times to thereby determine the number of lighting-up times of each class in one field period; and determining the number of lighting-up times of each line in one field period based on a result of classification on each line obtained by the second means and the number of lighting-up times of each class in one field period.

The correction processing performed by the fourth means is, for example, processing in which an input signal on each line in one field is level divided depending on the maximum number of lighting times among the numbers of lighting-up times of the respective classes and sub-signals obtained by the level division is caused to have a gain-up to thereby generate signals given to a self-light emitting display unit on each lighting-up.

BRIEF DESCRIPTION OF THE DRAWINGS

FIG. 1 is a block diagram showing an electric configuration of a display provided with a self-light emitting display unit such as an inorganic EL display or the like;

FIG. 4 is a table showing a model relationship between a condition in a lighting-up scheme determining section 42 and a selected lighting-up pattern;

FIG. 5 is a table showing a model example of control information in a case where a third pattern is selected as a lighting-up pattern;

FIG. 6 is a table showing a model flow of a control operation in a control section 5.

DETAILED DESCRIPTION OF THE PREFERRED EMBODIMENTS

Description will be given of embodiments of the present invention with reference to the accompanying drawings.

Figure 1:
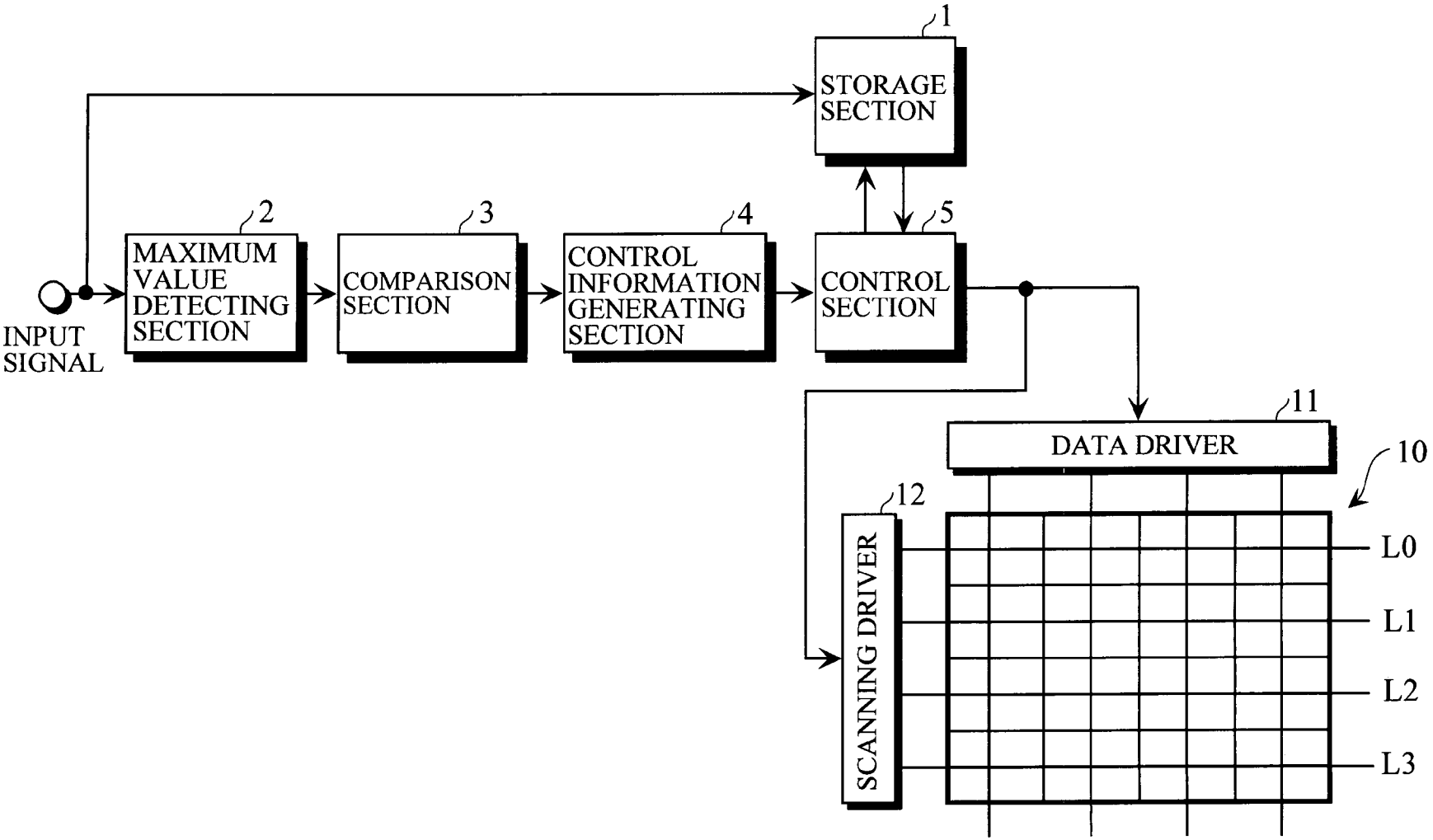

FIG. 1 shows an electric configuration of a display provided with a self-light emitting display unit such as an inorganic EL display or the like.

An input signal is sent to not only a storage section 1 but also a maximum value detecting section 2. Information included in one field is stored in the storage section 1.

The maximum value detecting section 2 detects the maximum value of input signals on each line. For example, in a case where a total number of lines is 4 and if line numbers are L0, L1, L2 and L3, respectively, by definition, the maximum value detecting section 2 detects the maximum values MAX0, MAX1, MAX2 and MAX 3 on each line.

The maximum values on the respective lines detected by the maximum value detecting section 2 are given to a comparison section 3. The comparison section 3 not only determines which of predetermined plural classes each of the lines belongs to using the maximum value of the line and plural threshold values, but also calculates a total number of lines belonging to the class. Description will be given later of details of the processing.

The result of classification of each line calculated by the comparison section 3 and the total number of lines of each class are given to a control information generating section 4. The control information generating section 4 determines a lighting-up scheme in one field period based on the result of classification of each line, a total number of lines belonging to each class and a predetermined total number of lighting-up times to generate control information necessary for lighting-up.

Control information generated by the control information generating section 4 is given to a control section 5. The control section 5 reads out a signal on a prescribed line from the storage section 1 based on the control information, corrects the read-out signal and gives the corrected signal to a data driver 11 of an inorganic EL display 10. The control section 5 sets an address corresponding to a prescribed line in a scanning driver 12 of the inorganic EL display 10.

Figure 2:
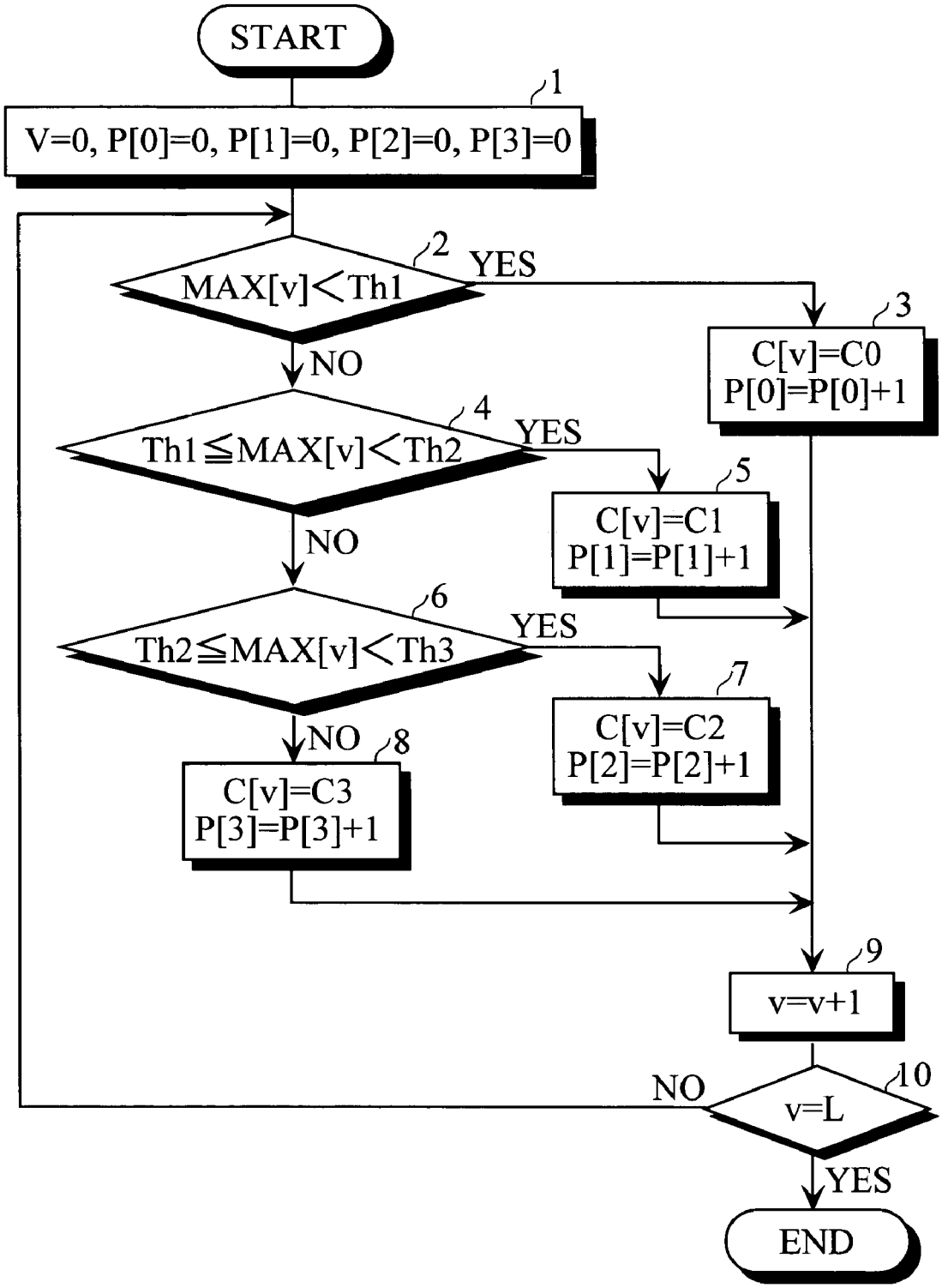
FIG. 2 is a flowchart showing a procedure for processing performed by a comparison circuit.

FIG. 2 show a procedure for processing performed by the comparison circuit 3. FIG. 2 shows a procedure for one filed.

In this procedure, the maximum values in the respective lines are classified into four classes C0, C1, C2 and C3 using three threshold values Th1, Th2 and Th3 (wherein Th1<Th2<Th3). The class C0 is the darkest class, while the class C3 is the brightest class. Total numbers of lines belonging to the first to fourth classes C0, C1, C2 and C3 are indicated with P[0], P[1], P[2] and P[3], respectively. Moreover, vindicates a line number beginning with 0. Therefore, if a total number of lines is L by definition, a range of v is $0 \leqq v < L$. A class corresponding to a line number v is indicated with C[v]. Besides, the maximum values of the respective lines detected by the maximum value detecting section 2 are indicated with MAX[0] to MAX[L−1].

TABLE 1

| Conditions | Classification results C [v] | Total number of lines |
|---|---|---|
| MAX [v] < Th1 | C0 | P [0] |
| Th1 ≦ MAX [v] < Th2 | C1 | P [1] |
| Th2 ≦ MAX [v] < Th3 | C2 | P [2] |
| Th3 ≦ MAX [v] | C3 | P [3] |

First of all, initially set are not only v=0, but also P[0]=P[1]=P[2]=P[3]=0 (step 1).

Then, it is determined whether or not MAX[v] is smaller than Th1 (step 2). If MAX[v] is smaller than Th1, not only is C[v]=C0 set, but a total number of lines P[0] belonging to C0 is incremented by 1 (P[0]=P[0]+1) (step 3). Then the process advances to step 9.

If in the step 2, it is determined that MAX[v] is Th1 or more, it is determined whether or not MAX[v] is Th1 or more and less than Th2 (step 4). If it is determined that MAX[v] is Th1 or more and less than Th2, not only is C[v]=C1 set, but a total number of lines P[1] belonging to C1 is incremented by 1 (P[1]=P[1]+1) (step 5). Then the process advances to step 9.

If in step 4, it is determined that MAX[v] is Th2 or more, it is determined whether or not MAX[v] is Th2 or more and less than Th3 (step 6). If MAX[v] is Th2 or more and less than Th3, not only is C[v]=C2 set, but a total number of lines P[2] belonging to C2 is incremented by 1 (P[2]=P[2]+1) (step 7). Then the process advances to step 9.

If in step 6, it is determined that MAX[v] is Th3 or more, not only is C[v] =C3 set, but a total number of lines P[3] belonging to C3 is incremented by 1 (P[3]=P[3]+1) (step 8). Then the process advances to step 9.

In step 9, v is incremented by 1 (v=v+1). That is, a line number is renewed. Then, it is determined whether or not v=L (step 10). If v≠L, that is if v<L, the process returns to step 2 to perform similar processing. If v=L, the processing this time ends since processings on all the lines has been completed.

Given to the control information generating section 4 are the results of classification C[0] to C[L−1] of the lines and total numbers of lines P[0] to P[3] belonging to the respective classes C0 to C3.

Figure 3:
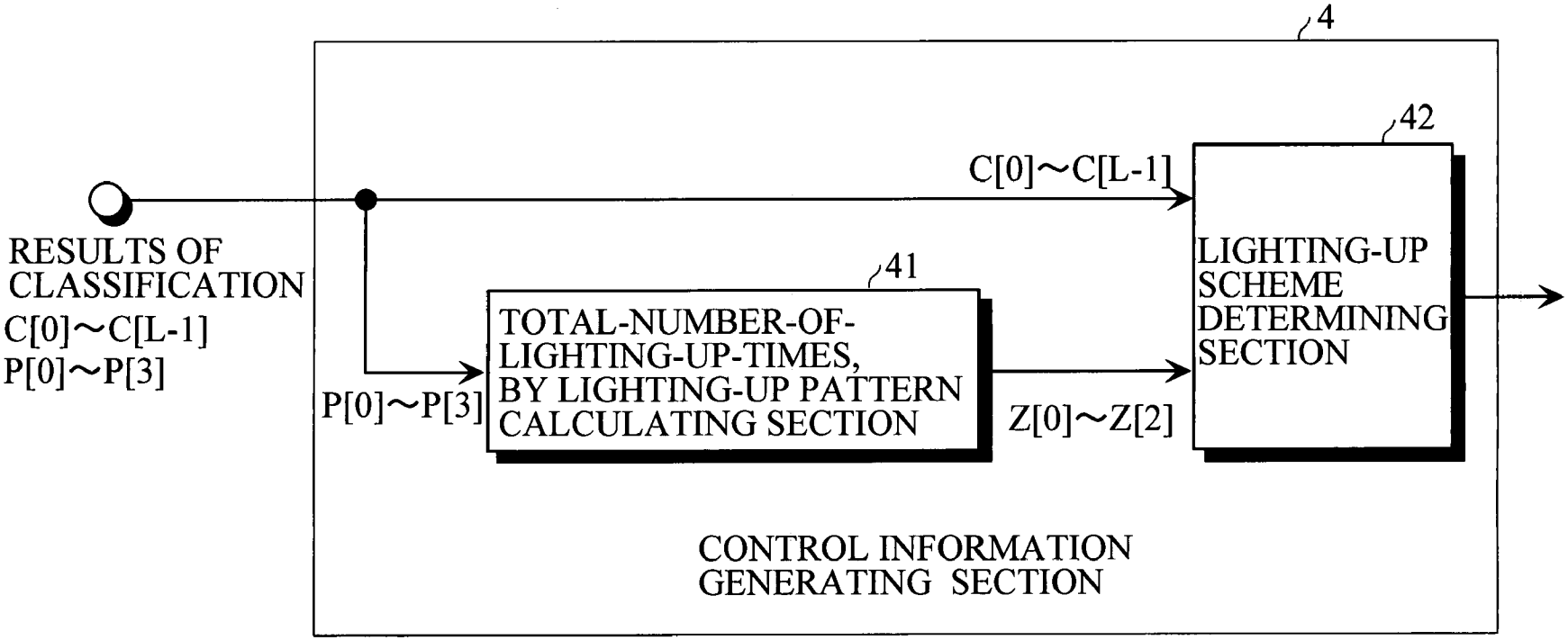
FIG. 3 is a block diagram showing a configuration of a control information generating section.

FIG. 3 shows a configuration of the control information generating section 4.

The total numbers of lines P[0] to P[3] belonging to the respective classes C0 to C3 are given to a total-number-of-lighting-up times, by lighting-up pattern calculating section 41. The results of classification C[0], to C[L−1] of the respective lines given from the comparison section 3 are given to a lighting-up scheme determining section 42.

The total-number-of-lighting-up-times, by lighting-up pattern calculating section 41 calculates a total number of lighting-up times (a total lighting-up times by lighting-pattern) Z[i] based on the total numbers P[0] to P[3] belonging to the respective classes C0 to C3 for each of predetermined plural kinds of lighting-up pattern.

In this example, there are three lighting-up patters described below:

A first pattern: a pattern that in one field period, each of the classes C0, C1, C2 and C3 is lit up once.

A second pattern: a pattern that in one field period, each of the classes C0 and C1 is lit up once, and each of the classes C2 and C3 is lit up twice.

A third pattern: a pattern that in one field period, the class C0 is lit up once, the class C1 is lit up twice, the class C2 is lit up thrice and the class C3 is lit up four times.

Total numbers of lighting-up times in the first to third patterns (a total of the numbers of lighting-up times of the respective lines) Z[0] , Z[0] and Z[2] are calculated based on the following formulae (1) to (3):

$$Z[0]=1\times\{P[0]+P[1]+P[2]+P[3]\} \quad (1)$$

$$Z[1]=1\times\{P[0]+P[1]\}+2\times\{P[2]+P[3]\} \quad (2)$$

$$Z[2]=1\times P[0]+2\times P[1]+3\times P[2]+4\times P[3] \quad (3)$$

A relation in magnitude among Z[0], Z[1] and Z[2] is that Z[0]≦Z[1]≦Z[2]. A total number of lighting-up times by lighting-up pattern Z[i] calculated by the total-number-of-lighting-up-times, by lighting-up pattern calculating section 41 is given to the lighting-up scheme determining section 42.

The lighting-up scheme determining section 42 compares a total number of lighting-up times by lighting-up pattern Z[i] with a total number of lighting-up times that lighting-up can actually performed in one field period. (a reference total number of lighting-up times) N, and not only is Z[i] that satisfies a condition of Z[i]≦N and is maximized determined as a total number of lighting-up times Z, but a lighting-up pattern to match Z[i] satisfying the above condition is also selected. The reference total number of lighting-up times N is determined by a performance of the inorganic EL display 10 and is obtained in advance. Then, the number of lighting-up times on each line is determined based on a selected lighting-up pattern and results of classification on the respective lines C[0] to C[L−1]. Then, generated is control information indicating the determined number of lighting-up times of each line.

If a condition that Z[2]≦N is satisfied as shown in FIG. 4, a total number of lighting-up times Z is Z[2] and the third light-up pattern is selected. If a condition that Z[1]≦N<Z[2] is satisfied, a total number of lighting-up times Z is Z[1] and the second lighting-up pattern is selected. If a condition that N<Z[1] is satisfied, a total number of lighting-up times is Z[0] and the first lighting-up pattern is selected.

FIG. 5 shows an example of control information in a case where a third pattern is selected as a lighting-up pattern. In FIG. 5, H and L are lighting-up flags and H indicates lighting-up and L non-lighting-up. The control information indicates that in one field period, a line belonging to C[0] is lit up once, a-line belonging to C[1] is lit up twice, a line belonging to C[2] is lit up thrice and a line belonging to C[3] is lit up 4 times.

The control section 5, as described above, reads out a signal for a prescribed line from the storage section 1 based on control information to correct the read-out signal and to then, give the corrected signal to the data driver 11 of the inorganic EL display 10. In addition, the control section 5 performs address setting in a scanning driver 12 of the inorganic EL display 10 so that a scanning electrode corresponding to a prescribed line is selected.

Then, description will be given of operations in the control section 5 in a case where the third lighting-up pattern is selected as an example.

As shown in FIG. 6, the control section 5 performs control on the lines in the first time of lighting-up, then control on the lines in the second time thereof, then control on the lines in the third time thereof and finally control on the lines in the fourth times thereof.

In the first time of lighting-up, a light-up flag is referred to from a line number v=0 and if a lighting-up flag is H, it is a lighting-up line; therefore an input signal for a line corresponding v=0 is read out from the storage section 1. Correction processing described later is performed on the read-out signal and thereafter, a signal to be outputted in the first time of lighting-up is outputted to the data driver 11. Address outputting is performed so that a scanning electrode corresponding to a line number this time is selected. Note that in the first time of lighting-up, such an operation is conducted on all the lines since lighting flags of all the lines are at H.

In the second time of lighting-up, input signals for lines for which lighting-up flags are at H are readout from the storage section 1, the read-out signals are subjected to correction processing described later and thereafter, not only is a signal to be outputted in the second time of lighting up outputted to the data driver 11, but an address outputting is also performed to the scanning driver 12 so that a scanning electrode corresponding to the line number is selected. No processing is performed on lines for which lighting-up flags are at L.

Description will be given of signal correction processing. Herein, description is firstly presented of correction processing on an input signal for a line belonging to the class C3 with four lighting-up times.

Figure 7:
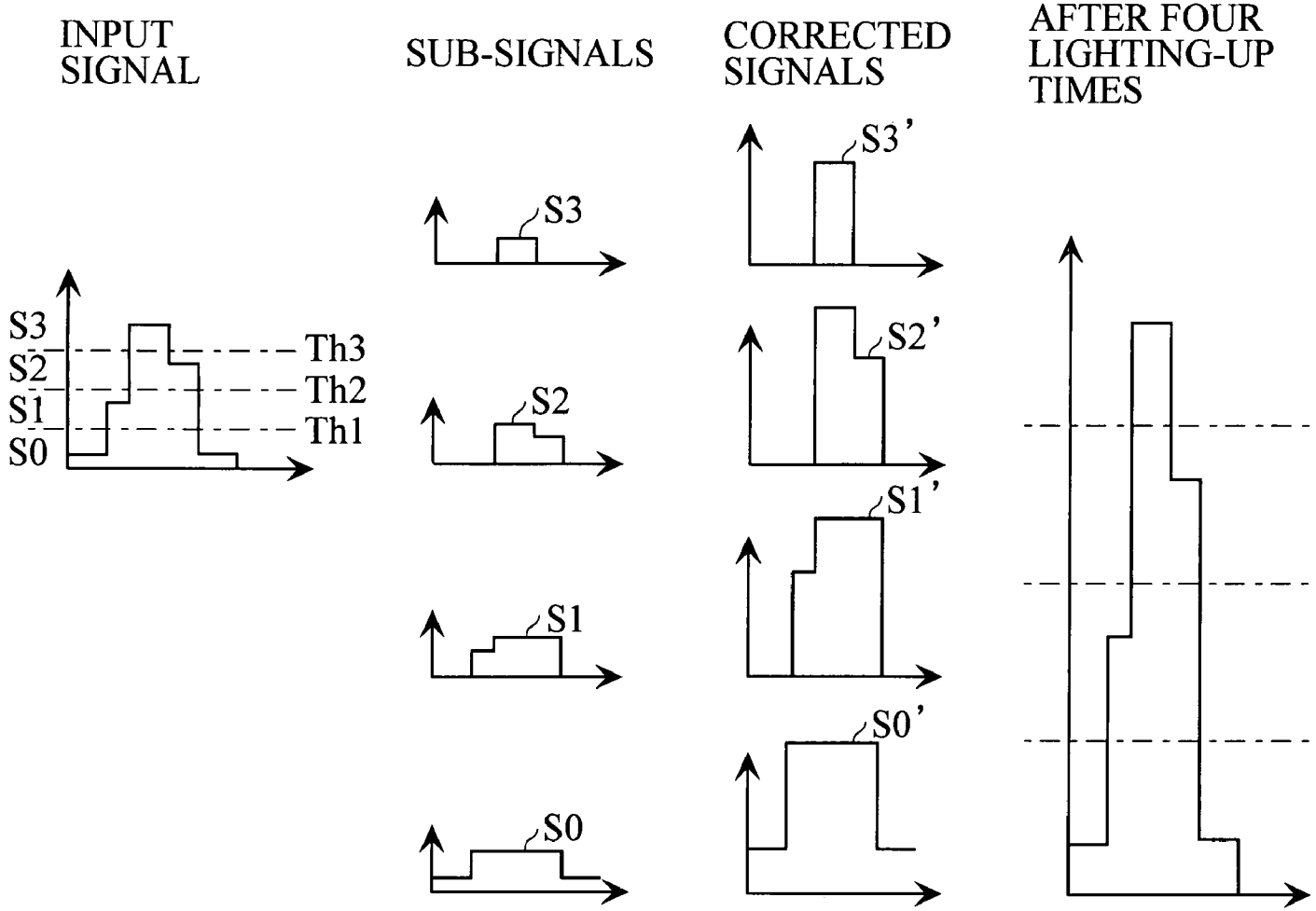
FIG. 7 is graphs describing model signal correction processing conducted by the control section 5.

An input signal read out from the storage section 1 is level divided according to the maximum lighting-up times (four times in this example). That is, the input signal is level divided using three threshold values Th1, Th2 and Th3 (wherein Th1<Th2<Th3). In a case of an input signal for a line belonging to the class C3, as shown in FIG. 7, the input signal is divided into four portions S0, S1, S2 and S3 from the low level side to a higher side to generate sub-signals S0, S1, S2 and S3 for the respective portions in the order with the lowest level set to 0 since the maximum value is larger than Th3.

In the first time of lighting-up, gain adjustment is applied to the sub-signal S0 to thereby obtain a corrected signal S0'. In a case of the class C3, four-fold gain-up is implemented since the maximum fourfold gain-up is possible. The corrected signal S0' after the gain-up is applied is outputted to the data driver 11, and information corresponding to the line number is also outputted to the scanning driver 12.

In the second time of lighting-up, gain adjustment is applied to the sub-signal S1 to thereby obtain a corrected signal S1'. The corrected signal S1' after the gain-up is applied is outputted to the data driver 11, and information corresponding to the line number is also outputted to the scanning driver 12.

In the third time of lighting-up, similar processing is performed on the sub-signal S2. In the fourth time of lighting-up, similar processing is performed on the sub-signal S3. As a result, a light amount four times that of the input signal can be obtained as shown in FIG. 7. That is, an ordinary input signal is outputted to the data driver 11 as it is to thereby increase a light amount by an amount corresponding to the gain-up as compared to that in the case-of one lighting-up time.

Since an input signal onto a line belonging to the class C0 with one lighting-up time has the maximum value smaller than Th1, the signal is of a value in the range of S0; therefore, a corrected signal after gain adjustment of the sub-signal S0 is outputted to the data driver 11 in the first lighting-up time.

Since an input signal onto a line belonging to the class C1 with two lighting-up times has the maximum value larger than Th1 and smaller than Th2, the signal is of a value in the range including S0 and S1, but not of a value in the range including S2 and S3; therefore, a corrected signal after gain adjustment of the sub-signal S0 is outputted to the data driver 11 in the first lighting-up time and a corrected signal after gain adjustment of the sub-signal S1 is outputted to the data driver 11 in the second lighting-up time.

Since an input signal onto a line belonging to the class C2 with three lighting-up times has the maximum value larger than Th2 and smaller than Th3, the signal is of a value in the range including S0, S1 and S2, but not of a value in the range including S3; therefore, a corrected signal after gain adjustment of the sub-signal S0 is outputted to the data driver 11 in the first lighting-up time, a corrected signal after gain adjustment of the sub-signal S1 is outputted to the data driver 11 in the second lighting-up time and a corrected signal after gain adjustment of the sub-signal S2 is outputted to the data driver 11 in the third lighting-up time.

According to this example, in an image that is dark on the whole but in which, bright portions are locally present, the bright portions can be brighter as compared with a conventional practice since a lighting-up pattern having a larger maximum number of lighting-up times can be selected.

What is claimed is:

1. A display with a self-light emitting display unit, comprising:

first means detecting the maximum value of input signals on each line;

second means not only determining which of predetermined plural classes each line belongs to using the maximum value of the line and predetermined threshold values, but also calculating a total number of lines belonging to each class;

third means determining the number of lighting-up times in each class in one field period based on the total number of lines belonging to the class obtained by the second means and a predetermined reference total number of lighting-up times and furthermore, determining the number of lighting-up times on each line in one field period based on a result of classification on the line obtained by the second means and the number of lighting-up times on each class in one field period; and fourth means not only performing correction processing for input signals on each line in one field based on the number of lighting-up times on each line in the one field period determined by the third means, but also controlling a self-light emitting display unit using the numbers of lighting-up times on each line in one field determined by the third means and an input signal after the correction processing.

2. The display according to claim 1, wherein the third means is means calculating a total number of lighting-up times based on a total number of lines belonging to each class obtained by the second means for each of plural lighting-up patterns wherein a pattern of the number of lighting-up times for each class is different from the other and comparing the calculated total number of lighting-up times with the predetermined reference total number of lighting-up times to thereby determine the number of lighting-up times of each class in one field period; and determining the number of lighting-up times on each line in one field period based on a result of classification on each line obtained by the second means and the number of lighting-up times of each class in one field period.

3. The display according to claim 1, wherein the correction processing performed by the fourth means is processing in which an input signal on each line in one field is level divided depending on the maximum number of lighting times among the numbers of lighting-up times of the respective classes and sub-signals obtained by the level division is caused to have a gain-up to thereby generate signals given to a self-light emitting display unit on each lighting-up.

4. The display according to claim 2, wherein the correction processing performed by the fourth means is processing in which an input signal on each line in one field is level divided depending on the maximum number of lighting times among the numbers of lighting-up times of the respective classes and sub-signals obtained by the level division is caused to-have a gain-up to thereby generate signals given to a self-light emitting display unit on each lighting-up.

* * * * *